US011238804B2

(12) United States Patent
Zhou

(10) Patent No.: US 11,238,804 B2
(45) Date of Patent: Feb. 1, 2022

(54) DRIVING METHOD AND DRIVING DEVICE FOR DISPLAY DEVICE

(71) Applicants: HKC Corporation Limited, Shenzhen (CN); Chongqing HKC Optoelectronics Technology Co., Ltd., Chongqing (CN)

(72) Inventor: Mancheng Zhou, Chongqing (CN)

(73) Assignees: HKC Corporation Limited, Shenzhen (CN); Chongqing HKC Optoelectronics Technology Co., Ltd., Chongqing (CN)

( * ) Notice: Subject to any disclaimer, the term of this patent is extended or adjusted under 35 U.S.C. 154(b) by 70 days.

(21) Appl. No.: 16/633,480

(22) PCT Filed: Dec. 14, 2017

(86) PCT No.: PCT/CN2017/116297

§ 371 (c)(1),
(2) Date: Jan. 23, 2020

(87) PCT Pub. No.: WO2019/029079

PCT Pub. Date: Feb. 14, 2019

(65) Prior Publication Data

US 2020/0175927 A1 Jun. 4, 2020

(30) Foreign Application Priority Data

Aug. 8, 2017 (CN) ..... 201710672409.1

(51) Int. Cl.
*G09G 3/3266* (2016.01)
*G09G 3/36* (2006.01)

(52) U.S. Cl.
CPC ..... *G09G 3/3266* (2013.01); *G09G 3/3674* (2013.01); *G09G 2310/0248* (2013.01)

(58) Field of Classification Search
CPC ..... G09G 3/3266; G09G 3/3674; G09G 2310/0248
See application file for complete search history.

(56) References Cited

U.S. PATENT DOCUMENTS 7,224,353 B2 * 5/2007 Song ..... G02F 1/13452 345/103
2006/0061560 A1 * 3/2006 Yamashita ..... G09G 3/3266 345/204

(Continued)

FOREIGN PATENT DOCUMENTS

CN 1363921 A 8/2002
CN 105609045 A 5/2016
CN 107393460 A 11/2017

*Primary Examiner* — Ariel A Balaoing
(74) *Attorney, Agent, or Firm* — Wang Law Firm, Inc.

(57) ABSTRACT

A driving method and a driving device (100) for a display device (200). The display device (200) comprises a pixel array consisting of several rows of sub-pixels, and each row of sub-pixels is correspondingly connected to a scan line. The driving method comprises: partitioning each row of sub-pixels into different areas, and taking the areas of the each row of sub-pixels as the charging start point positions of the scan line corresponding to the each row of sub-pixels (S101); and inputting scanning voltage signals to the different areas of a row of sub-pixels corresponding to each scan line through the charging start point positions of the each scan line to perform partition scanning for the each row of sub-pixels (S102).

8 Claims, 5 Drawing Sheets

(56) References Cited

U.S. PATENT DOCUMENTS

| | | | | |
|---|---|---|---|---|
| 2007/0001960 | A1* | 1/2007 | Kim | G09G 3/3677 345/92 |
| 2007/0229413 | A1* | 10/2007 | Hara | G09G 3/3275 345/76 |
| 2008/0297539 | A1* | 12/2008 | Kim | G09G 3/3648 345/690 |
| 2011/0148852 | A1* | 6/2011 | Kim | G09G 3/20 345/213 |
| 2013/0222357 | A1* | 8/2013 | Tseng | G09G 3/3677 345/212 |
| 2015/0130777 | A1* | 5/2015 | Park | H01L 27/1218 345/206 |
| 2015/0154902 | A1* | 6/2015 | Lee | G09G 3/20 345/213 |
| 2016/0019852 | A1* | 1/2016 | Kim | G09G 3/3666 345/103 |
| 2017/0061890 | A1* | 3/2017 | Zhou | G09G 3/3266 |
| 2017/0178557 | A1* | 6/2017 | Li | G09G 3/3266 |
| 2018/0174531 | A1* | 6/2018 | Chen | G09G 3/3674 |
| 2019/0005702 | A1* | 1/2019 | Takimoto | G06T 15/005 |
| 2020/0118511 | A1* | 4/2020 | Chen | G09G 3/3648 |

* cited by examiner

DRIVING METHOD AND DRIVING DEVICE FOR DISPLAY DEVICE

CROSS-REFERENCE TO RELATED APPLICATION

This application claims priority to China Patent Application No. 201710672409.1 filed on Aug. 8, 2017, and entitled "Driving method and driving device of display device" at State Intellectual Property Office of the P.R.C, the entirety of which is hereby incorporated by reference.

BACKGROUND

1. Field

The embodiment of the present application belongs to the field of the display technology, and more particularly, relates to a driving method and a driving device for display device.

2. Description of the Related Art

The above information disclosed in this Background section is for providing the background of the present disclosure and therefore it may contain information that may not form a prior art that is known to a person of ordinary skill in the art.

With the improved developments of display technology, various display apparatus such as a liquid crystal panel and displayer are moving in the directions of light weight, large view screen, low-power consumption and low-cost. In the present, the commonly used driving method of the display device is the Tri-Gate driving method based on Tri-Gate transistor technology and Dual Gate driving method based on Dual Gate transistor technology. No matter which kind of driving method is used to process the row scan driving, it all charges each of the sub-pixels connected to the scan line one by one through inputting the scan driving signal from the starting end of the scan line to the finishing end of the scan line.

However, since there is a parasitic capacitance between the scan line and the data line, between the adjacent scan lines, between the scan line and the transistor, or between the scan line and the sub-pixels, the parasitic capacitance constitutes the driving load on the scan line, so that the scan driving signal generates a loss during the process from the starting end to the finishing end of the scan line. This results in prolonging the charging time of the sub-pixels which is close to the finishing end of the scan line, so as to make the uneven charging time of the sub-pixels connected on the entire scan line.

SUMMARY

According to one aspect of the embodiment of the present invention, a driving method is provided. The display device comprises a pixel array; the pixel array is consisting of a plurality of rows of sub-pixels; and each row of the sub-pixels is correspondingly connected to one scan line;

the driving method comprises the steps of:

dividing each row of the sub-pixels into zones respectively, and using the zone position of each row of the sub-pixels as a charging start point position of the scan line corresponding to each row of the sub-pixels, and inputting a scan voltage signal to different regions of one row of the sub-pixels corresponding to each scan line respectively by the charging start position of each scan line to execute zone scanning for each row of the sub-pixels.

According to another aspect of the embodiment of the present invention, a driving device for a display device is provided. The display device comprises a pixel array; the pixel array is consisting of M rows of sub-pixels; each row of the sub-pixels is connected to one scan line respectively; each row of the sub-pixels comprises at least two zones; and the zone position of each row of the sub-pixels is a charging start point position of corresponding scan line, wherein $M \geq 1$ and M is positive integer;

the driving device comprising:

a scan driving modules connected to the charging start point of each scan line respectively and used to input a scan voltage signal to different regions of each row of the sub-pixels respectively through the charging start point of each scan line to execute zone scanning for each row of the sub-pixels.

According to a further aspect of the embodiment of the present invention, a driving method is provided. A driving method, wherein the display device comprises a pixel array;

the pixel array consists of a plurality of rows of sub-pixels; and each row of the sub-pixels is correspondingly connected to one scan line;

the driving method comprises the steps of:

dividing each row of the sub-pixels into zones respectively, and using the zone position of each row of the sub-pixels as a charging start point position of the scan line corresponding to each row of the sub-pixels, and inputting a scan voltage signal to different regions of one row of the sub-pixels corresponding to each scan line respectively by the charging start position of each scan line to execute zone scanning for each row of the sub-pixels;

wherein if a number of the sub-pixels comprised in each row of the sub-pixels is an odd number, the charging start point position of each scan line is in a position where the middle sub-pixels of a corresponding row of sub-pixels and the scan line are connected;

if a number of the sub-pixels comprised in each row of the sub-pixels is an even number, the charging start point position of each scan line is located between two middle sub-pixels of a corresponding row of sub-pixels.

BRIEF DESCRIPTION OF THE DRAWINGS

The accompanying drawings required for describing embodiments will be briefly described herein, for explaining the technical solutions of the embodiments of the present application more clearly. Apparently, the accompanying drawings in the following description are some embodiments of the present application. A person having ordinary skill in the art is able to obtain other drawings according to these appending drawings without under the premise of paying creative labor. In the accompanying drawings.

DESCRIPTION OF THE PREFERRED EMBODIMENTS

In order to make a person having ordinary skill in the art understand the present application more easily, the technical solutions in the embodiments of the present application will be clearly described below with reference to the accompanying drawings in the embodiments of the present application. Obviously, the following accompanying drawings are some embodiments of the present application and are not all embodiments. Based on the embodiments of the present application, other embodiments obtained by a person having ordinary skill in the art without under the premise of paying creative labor should fall in the protected scope of the present application.

In the specification, claims of the present application and the accompanying drawings described above, the term "comprise" and any modification thereof are intended to cover the non-exclusive inclusion. For example, a process, a method, a system, a product, or an apparatus that comprises a series of steps or units is not limited to comprise the listed steps or units, but optionally comprises the steps or units are not listed or optionally comprises the other inherent steps or units of the process, the method, the system, the product, or the apparatus. In addition, the terms "the first", "the second" and "the third" etc. are used to distinguish different objects rather than to describe a particular order.

The embodiment of the present application provides a driving method and a driving device for display device. The purpose of the present application is to solve the problem of parasitic capacitance that exists between the scan line and the data line, between the adjacent scan lines, between the scan line and the transistor, or between the scan line and the sub-pixels. This parasitic capacitance constitutes the driving load on the scan line, so that the scan driving signal generates a loss during the process from the starting end to the finishing end of the scan line. This results in prolonging the charging time of the sub-pixels which is close to the finishing end of the scan line, so as to make the uneven charging time of the sub-pixels connected on the entire scan line.

Figure 1:
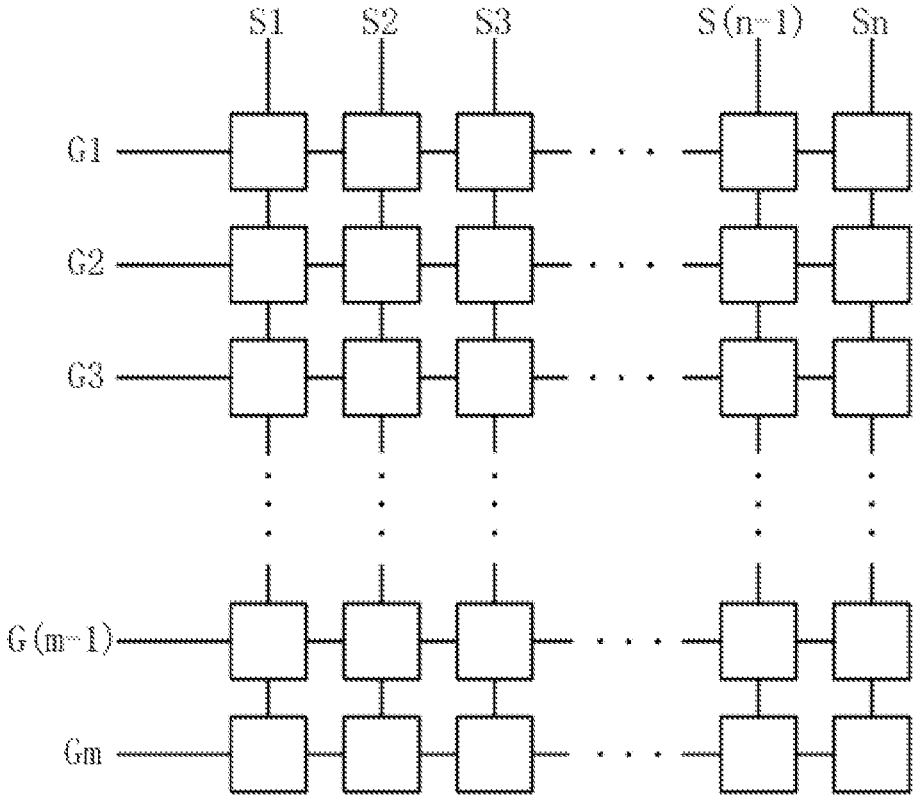
FIG. 1 is a driving schematic diagram of a pixel array in accordance with one example of the present application.

Referring to FIG. 1, it exemplarily shows a pixel array consisting of m rows and n columns of sub-pixels, wherein m and n are larger than 0 and are positive integers.

Optionally, the number of the scan lines is different according to the adopted gate driving method. If the Tri-Gate driving method is adopted, each scan line connects to a row of the sub-pixels correspondingly. The number of the scan lines is the same as the number of rows of the pixel array. If the Dual Gate driving method is adopted, each three rows of the sub-pixels connect to two scan lines correspondingly. One row of the sub-pixels in each three rows of the sub-pixels correspondingly connects to one scan lines of the two scan lines. The other two rows of the sub-pixels in each three rows of the sub-pixels correspondingly connect to another scan line. The number of the scan lines is less than the number of rows of the pixel array.

In FIG. 1, it exemplarily shows a pixel array driven by the Tri-Gate driving method. The pixel array comprises m scan lines and n data line denoted as G1, G2, G3, . . . and Gm and S1, S2, S3, . . . and Sn.

As shown in FIG. 1, the driving principle of the pixel array is described in the following:

The Gate drive IC is respectively connected to each of the scan lines to drive the pixel array line by line. A scan driving signal is input from a starting end of a scan line correspondingly connected to each row of sub-pixels to a finishing end of the scan line, so as to charge each of the sub-pixels connected to the scan line one by one.

Since there is parasitic capacitance between the scan line and the data line, between the adjacent scan lines, between the scan line and the transistor, or between the scan line and the sub-pixels, the parasitic capacitance constitutes the driving load on the scan line, so that the scan driving signal generates a loss during the process from the starting end to the finishing end of the scan line. Therefore, if we use the known row scan driving method to process the row scan driving to the sub-pixels, the charging time of the sub-pixels which is close to the finishing end of the scan line will increase and the signal will be delayed, so as to make the charging time of the sub-pixels connected on the entire scan line uneven.

Figure 2:
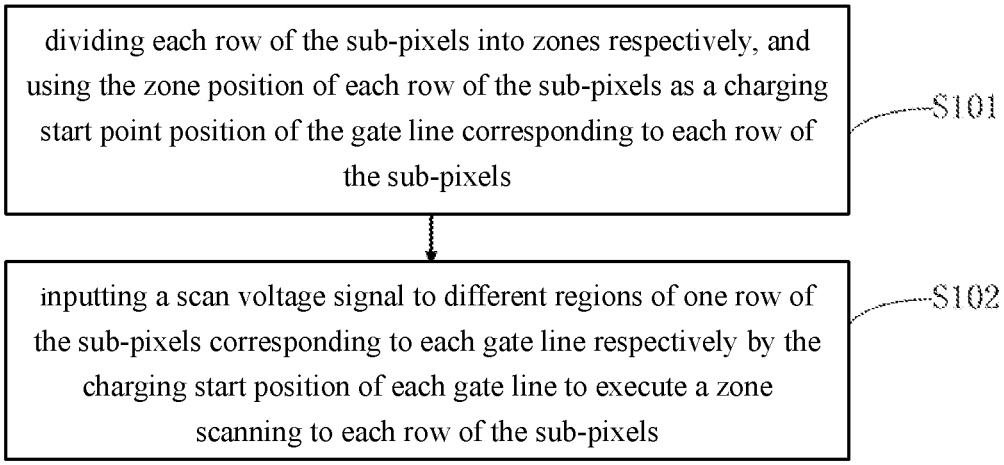
FIG. 2 is a flow block diagram of a driving method in accordance with one embodiment of the present application.

As shown in FIG. 2, in order to solve the problem generated in the driving process of the pixel array in FIG. 1, one embodiment of the present application provides a driving method, the driving method comprises the steps of:

Step S101: dividing each row of the sub-pixels into zones respectively, and using the zone position of each row of the sub-pixels as a charging start point position of the scan line corresponding to each row of the sub-pixels; and Step S102: inputting a scan voltage signal to different regions of one row of the sub-pixels corresponding to each scan line respectively by the charging start position of each scan line to execute zone scanning for each row of the sub-pixels.

Optionally, each row of the sub-pixels can be divided into at least two zones. The number of the charging start point positions of each scan line is equal to the number of the zones of the row of the sub-pixels corresponding to the scan line minus one. That is, if one row of the sub-pixels is divided into N zones, the number of the charging start point of the scan line corresponding to the row of the sub-pixels is N−1. The position of the scan line is located in the middle position of the adjacent two zones.

In one embodiment, if each row of the sub-pixels divided into two zones, the middle point position located between each row of the sub-pixel is used as the charging start point. The effect of reducing the difference of the charging time between the sub-pixels connected to the two ends of the scan line is better, so as to make the charging time of any two sub-pixels symmetrically disposed on both sides of the middle point position equal to each other. Based on the middle point position, the charging time of the sub-pixels located on the both sides of the middle point is sequentially increased from the near one to the far one.

In one embodiment, the charging start point position of each scan line is the same.

If a number of the sub-pixels comprised in each row of the sub-pixels is an odd number, the charging start point position of each scan line is a position where the middle sub-pixels of a corresponding row of sub-pixels and the scan line are connected;

If a number of the sub-pixels comprised in each row of the sub-pixels is an even number, the charging start point position of each scan line is located between two middle sub-pixels of a corresponding row of sub-pixels.

Figure 3:
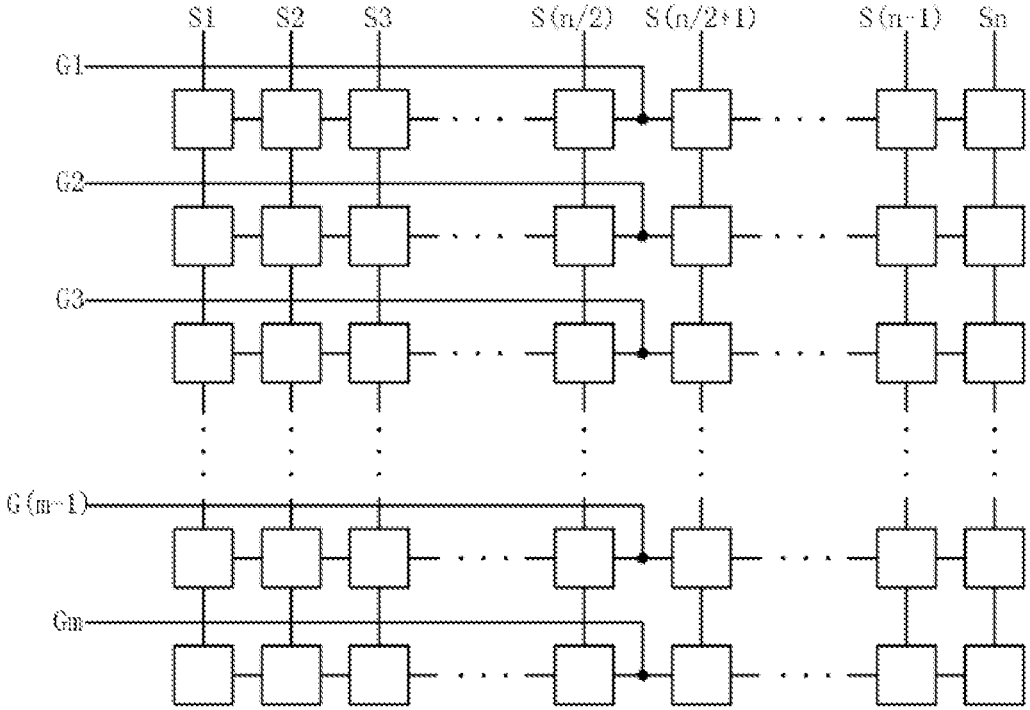
FIG. 3 is a driving schematic diagram of a pixel array in accordance with one embodiment of the present application.

As shown in FIG. 3, one embodiment of the present application exemplarily shows a case that when the number of the sub-pixels comprised in each row of the sub-pixels is an even number, the charging start point position of each scan line is the same. In FIG. 3, the charging start point of $1^{st}$ scan lines G1 is located between $n/2^{th}$ sub-pixel and $n/2+1^{th}$ sub-pixel of the $1^{st}$ row of the sub-pixels; the charging start point of $2^{nd}$ scan lines G2 is located between $n/2^{th}$ sub-pixel and $n/2+1^{th}$ sub-pixel of $2^{nd}$ row of the sub-pixels; the charging start point of $3^{rd}$ scan lines G3 is located between $n/2^{th}$ sub-pixel and $n/2+1^{th}$ sub-pixel of $3^{rd}$ row of the sub-pixels; . . . the charging start point of $m^{th}$ scan lines Gm is located between $n/2^{th}$ sub-pixel and $n/2+1^{th}$ sub-pixel of $m^{th}$ row of the sub-pixels; wherein n is an even number.

In one embodiment, the charging start point position of each scan line is not completely the same. The display device comprises N scan lines;

a charging start point position of $i^{th}$ scan line is a position where $j^{th}$ sub-pixel of a corresponding row of the sub-pixels and $i^{th}$ scan line are connected; or a charging start point position of $i^{th}$ scan line is located between $j^{th}$ sub-pixel and j−1 the sub-pixel of a corresponding row of the sub-pixels;

wherein, $N \geq i \geq 1$, $j>1$ and N, i, j are positive integers.

Optionally, the charging start point may be also disposed in the different position in according to the actual requirement, as long as the charging start position is not located at the starting end or the finishing end of the scan line.

Figure 4:
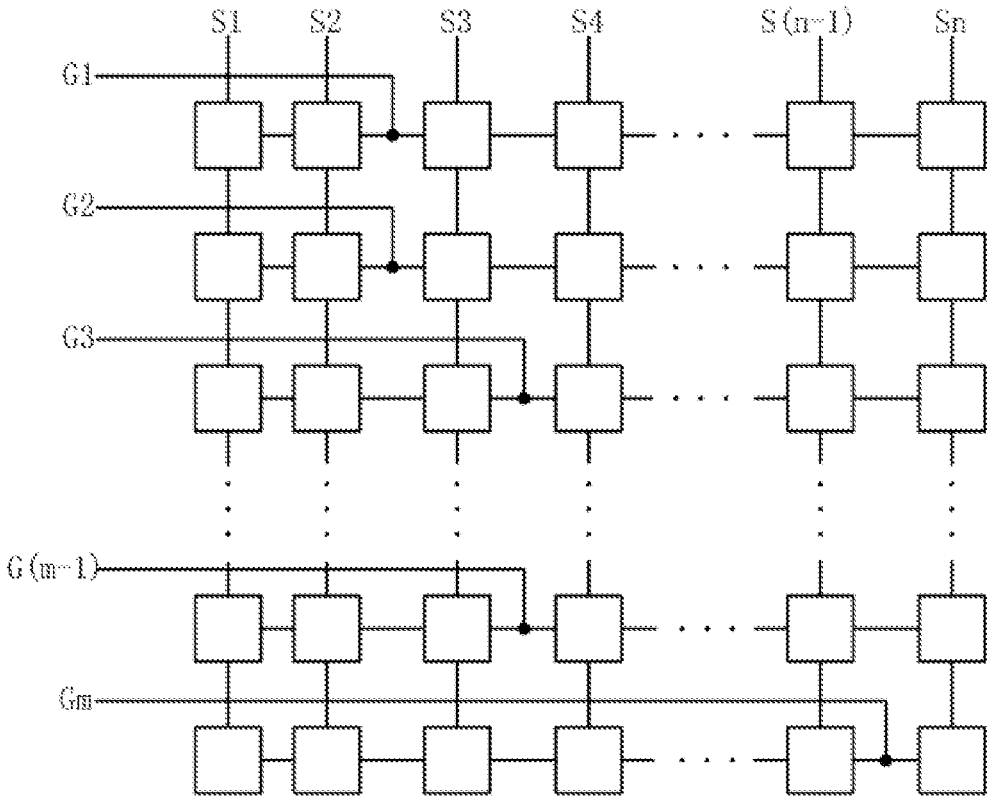
FIG. 4 is a driving schematic diagram of a pixel array in accordance with another embodiment of the present application.

As shown in FIG. 4, one embodiment of the present application exemplarily shows a case that the charging start point position of each scan line is not completely the same. In FIG. 4, the charging start point of $1^{st}$ scan lines G1 is located between $2^{nd}$ sub-pixel and $3^{rd}$ sub-pixel of $1^{st}$ row of the sub-pixels; the charging start point of $2^{nd}$ scan lines G2 is located between $2^{nd}$ sub-pixel and $3^{rd}$ sub-pixel of $2^{nd}$ row of the sub-pixels; the charging start point of $3^{rd}$ scan lines G3 is located between $3^{rd}$ sub-pixel and $4^{th}$ sub-pixel of $3^{rd}$ row of the sub-pixels; . . . the charging start point of $m^{th}$ scan lines Gm is located between $n-1^{th}$ sub-pixel and $n^{th}$ sub-pixel of $m^{th}$ row of the sub-pixels.

Optionally, the number of the scan lines is determined by the adopted scan driving method to the pixel array. The adopted driving method in the embodiment corresponding to FIG. 3 and FIG. 4 is a Tri-Gate driving method. That is, the number of each row of the sub-pixels is the same as a number of the scan lines of the display device. Each scan line is connected to a row of sub-pixels correspondingly.

Figure 5:
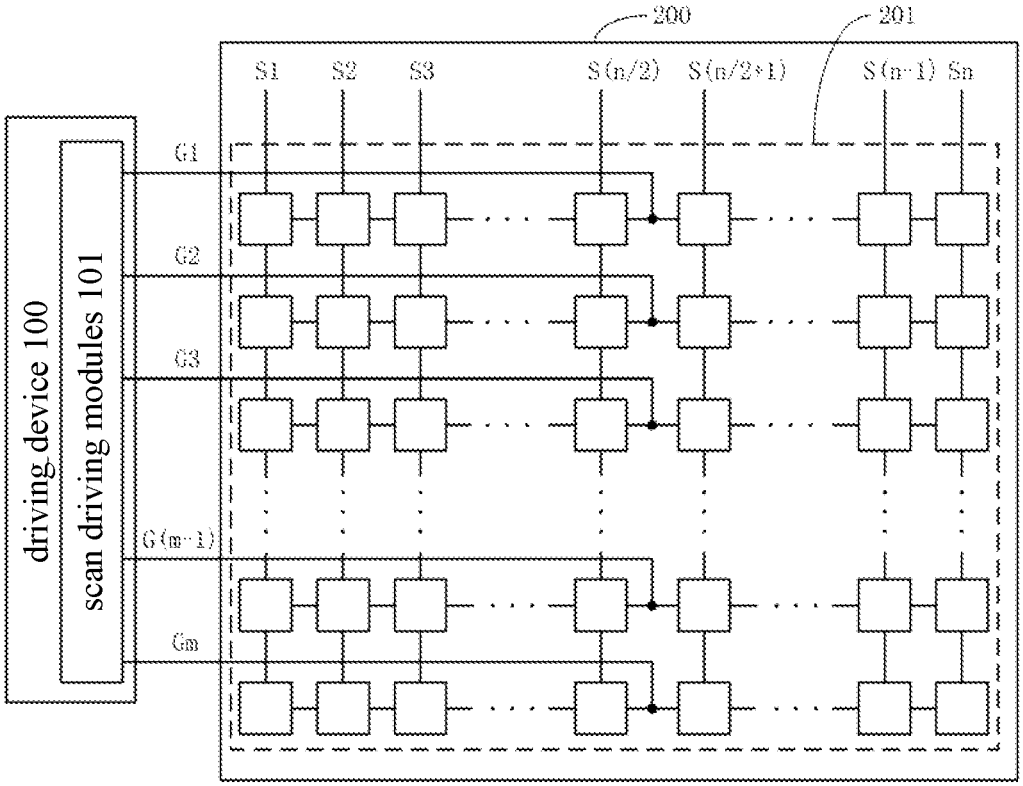
FIG. 5 is a schematic diagram of the structure of the driving device in accordance with one embodiment of the present application.

As shown in FIG. 5, one embodiment of the present application provides a driving device 100 applied to a display device 200.

Wherein the display device 200 comprises:

a pixel array 201 consisting of M rows of sub-pixels. Each row of the sub-pixels is connected to one scan line respectively. Each row of the sub-pixels comprises at least two zones. The zone position of each row of the sub-pixels is a charging start point position of corresponding scan line. Wherein, $M \geq 1$ and M is positive integer.

In FIG. 5, it exemplarily shows the display device 200 implemented by the pixel array in the embodiment corresponding to FIG. 3.

the driving device 100 comprises:

a scan driving module 101 connected to the charging start point of each scan line respectively and used to input a scan voltage signal to different regions of each row of the sub-pixels respectively through the charging start point of each scan line to execute zone scanning for each row of the sub-pixels.

In one embodiment, the position where the scan driving modules is connected to each row of sub-pixels is the same;

if a number of the sub-pixels comprised in each row of the sub-pixels is an odd number, the scan driving module is connected to a middle sub-pixel of each row of the sub-pixels;

if a number of the sub-pixels comprised in each row of the sub-pixels is an even number, the scan driving module is connected to a position located between two middle sub-pixels of each row of the sub-pixels.

In one embodiment, the position where the scan driving modules is connected to each row of sub-pixels is not completely the same.

In one embodiment, the aforementioned display device comprises N scan lines;

the scan driving modules is connected to $j^{th}$ sub-pixel of a row of the sub-pixels through $i^{th}$ scan line; or the scan driving modules is connected to the position where is located between $j^{th}$ sub-pixel and $j-1^{th}$ sub-pixel of a row of the sub-pixels through $i^{th}$ scan line;

wherein, $N \geq i \geq 1$, $j>1$ and N, i, j are positive integers.

In one embodiment, a number of each row of the sub-pixels of the aforementioned scan pixel array is the same as a number of the scan lines of the display device; and each scan line is connected to a row of sub-pixels correspondingly.

In one embodiment, the aforementioned scan driving modules is a gate driving modules. The gate driving modules is connected to N scan lines and used to sequentially input a scan voltage signal to each row of the sub-pixels through each scan lines, so as to execute zone scanning for each row of the sub-pixels.

Optionally, the gate driving modules may specifically be a gate driver IC or other circuits or elements having the same or the corresponding effect.

In one embodiment, the aforementioned display device further comprises a source driving modulus. The source driving modulus is connected to each row of the sub-pixels of the pixel array respectively and used to sequentially input a data driving voltage signal to each column of the sub-pixels, so as to execute data driving to each column of the sub-pixels.

Optionally, the source driving modules may specifically be a source driver IC or other circuits or elements having the same or the corresponding effect.

Figure 6:
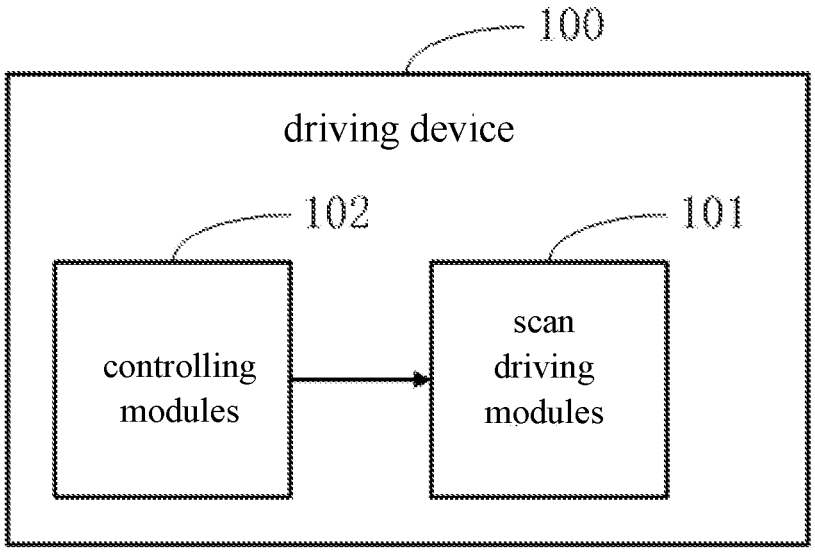
FIG. 6 is a schematic diagram of the structure of the driving device in accordance with one embodiment of the present application.

As shown in FIG. 6, one embodiment of the present application further provides a driving device 100 applied to the aforementioned display device. The driving device 100 comprises:

a scan driving modules 101 connected to the charging start point of each scan line respectively and used to input a scan voltage signal to each row of the sub-pixels respectively through the charging start point of each scan line, so as to execute zone scanning for each row of the sub-pixels; and a controlling modules 102 connected to the scan driving modules 101 and used to output a control signal, so as to control the working state of the scan driving modules.

Optionally, the scan driving modules may be any elements or circuits having the function of the scan charging to the pixel of the display panel, such as Gate Driver IC or G-COF (Gate-Chip on Film).

Optionally, the controlling modules may be implemented by the general integrated circuits such as CPU (Central Processing Unit) or ASIC (Application Specific Integrated Circuit). It is also a Timer Control Register (TCON).

Figure 7:
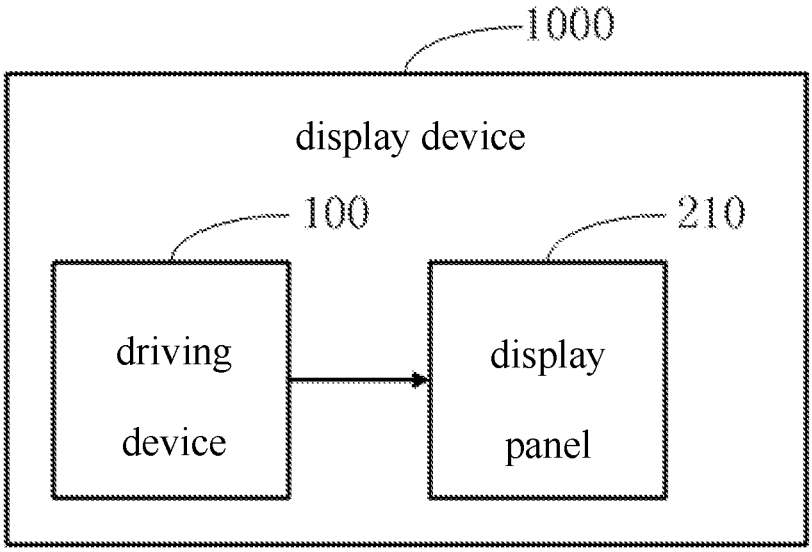
FIG. 7 is a schematic diagram of the structure of the driving device in accordance with one embodiment of the present application.

As shown in FIG. 7, one embodiment of the present application provides a driving device 1000 comprising display panel 210 and aforementioned driving device 100. The driving device 100 is connected to the display panel 210.

In one embodiment, the display panel comprises the aforementioned pixel array based on the Tri-Gate driving method.

In one embodiment, the display panel may be any kind of display panel such as liquid crystal display panel based on the LCD (Liquid Crystal Display) technology, organic electroluminescence display panel based on the OLED (Organic Electroluminescence Display) technology, quantum dot light emitting diodes display panel based on the QLED (Quantum Dot Light Emitting Diodes) technology or the curved display panel.

Through disposing the charging start point of each scan line connected to the pixel array as the non-starting end and the non-finishing end, the embodiment of the present application can make the charging time of the sub-pixels correspondingly disposed symmetrically about the charging start point consistent and decrease the difference of the charging time between the sub-pixels connected to the two ends of the scan line, so as to make the charging time of the sub-pixels connected to entire scan line more even.

In one embodiment, the modules in the embodiment of the present application may all be implemented by the general integrated circuits such as CPU (Central Processing Unit) or ASIC (Application Specific Integrated Circuit).

A person having ordinary skill in the art can understand that the entire or part of the process in the aforementioned embodiment of the method can be completed by the related hardware commanded through the computer program. The program may store in one storage media which can be read by a computer. When the program is processed, it may comprise the process such as the process of the embodiment of various method mentioned above. Wherein, the storage media may be a magnetic disc, optical disk, Read-Only Memory (ROM) or Random Access Memory (RAM) etc.

The description above is only the preferred embodiments of the present application and is not intended to limit the present application. Any modifications, equivalent replacements and improvements made in the spirit and the principle of the present application should be comprised in the scope of the protection of the present application.

What is claimed is:

1. A driving method, wherein:

the display device comprises a pixel array;

the pixel array comprises a plurality of rows of sub-pixels; and each row of the sub-pixels is correspondingly connected to one of scan lines; and the driving method comprises the steps of:

dividing each row of the sub-pixels into zones respectively, and using the zone position of each row of the sub-pixels as a charging start point position of the scan line corresponding to each row of the sub-pixels, and inputting a scan voltage signal to different regions of one row of the sub-pixels corresponding to each of scan lines respectively by the charging start position of each of scan lines to execute zone scanning for each row of the sub-pixels;

wherein the charging start point position of each scan line is the same;

if a number of the sub-pixels comprised in each row of the sub-pixels is an odd number, the charging start point position of each scan line is a position where the middle sub-pixels of a corresponding row of sub-pixels and the scan line are connected;

if a number of the sub-pixels comprised in each row of the sub-pixels is an even number, the charging start point position of each scan line is located between two middle sub-pixels of a corresponding row of sub-pixels.

2. A driving device for a display device, wherein:

the display device comprises a pixel array;

the pixel array is consisting of M rows of sub-pixels;

each row of the sub-pixels is connected to one scan line respectively;

each row of the sub-pixels comprises at least two zones; and the zone position of each row of the sub-pixels is a charging start point position of corresponding scan line, wherein $M \geq 1$ and M is positive integer;

the driving device comprising:

a scan driving modules connected to the charging start point of each scan line respectively and used to input a scan voltage signal to different regions of each row of the sub-pixels respectively through the charging start point of each scan line to execute zone scanning for each row of the sub-pixels;

wherein the position where the scan driving modules is connected to each row of sub-pixels is the same;

if a number of the sub-pixels comprised in each row of the sub-pixels is an odd number, the scan driving module is connected to a middle sub-pixel of each row of the sub-pixels;

if a number of the sub-pixels comprised in each row of the sub-pixels is an even number, the scan driving module is connected to a position located between two middle sub-pixels of each row of the sub-pixels.

3. A driving method, wherein:

the display device comprises a pixel array;

the pixel array is consisting of a plurality of rows of sub-pixels; and each row of the sub-pixels is correspondingly connected to one scan line;

the driving method comprises the steps of:

dividing each row of the sub-pixels into zones respectively, and using the zone position of each row of the sub-pixels as a charging start point position of the scan line corresponding to each row of the sub-pixels, and inputting a scan voltage signal to different regions of one row of the sub-pixels corresponding to each scan line respectively by the charging start position of each scan line to execute zone scanning for each row of the sub-pixels;

wherein if a number of the sub-pixels comprised in each row of the sub-pixels is an odd number, the charging start point position of each scan line is a position where the middle sub-pixels of a corresponding row of sub-pixels and the scan line are connected;

if a number of the sub-pixels comprised in each row of the sub-pixels is an even number, the charging start point position of each scan line is located between two middle sub-pixels of a corresponding row of sub-pixels.

4. The driving method of claim 3, wherein the charging start point position of each scan line is not completely the same.

5. The driving method of claim 4, wherein the display device comprises N scan lines;

a charging start point position of $i^{th}$ scan line is a position where $j^{th}$ sub-pixel of a corresponding row of the sub-pixels and $i^{th}$ scan line are connected; or a charging start point position of $i^{th}$ scan line is located between $j^{th}$ sub-pixel and $j-1^{th}$ sub-pixel of a corresponding row of the sub-pixels;

wherein, $N \geq i \geq 1$, $j>1$ and N, i, j are positive integers.

6. The driving method of claim 3, wherein:

a number of rows of the pixel array is the same as a number of the scan lines of the display device; and each scan line is connected to a row of sub-pixels correspondingly.

7. The driving method of claim 3, wherein:

the pixel array is consisting of M rows of sub-pixels;

each row of the sub-pixels is connected to one scan line respectively;

each row of the sub-pixels comprises at least two zones and the zone position of each row of the sub-pixels is a charging start point position of corresponding scan line;

wherein $M \geq 1$ and M is positive integer.

8. The driving method of claim 7, wherein:

the driving device comprises a scan driving modules connected to the charging start point of each scan line respectively and used to input a scan voltage signal to different regions of each row of the sub-pixels respectively through the charging start point of each scan line to execute zone scanning for each row of the sub-pixels.

* * * * *